United States Patent [19]

Fischer et al.

[11] 4,253,781

[45] Mar. 3, 1981

[54] METHOD AND AN APPARATUS FOR PROVIDING A GROUTED ANCHORAGE AGAINST HYDROSTATIC PRESSURE

[75] Inventors: Joachim Fischer, Dormagen-Zons; Siegfried Brandl, Solingen; Rudolf Bartoszek, Ratingen, all of Fed. Rep. of Germany

[73] Assignee: Philipp Holzmann Aktiengesellschaft, Frankfurt am Main, Fed. Rep. of Germany

[21] Appl. No.: 18,712

[22] Filed: Mar. 8, 1979

[51] Int. Cl.[3] ..... E02D 5/74; E21D 20/02

[52] U.S. Cl. ..... 405/260; 405/266; 405/269

[58] Field of Search ..... 405/260, 269, 266, 264, 405/259; 166/295; 141/311 R, 392

[56] References Cited

U.S. PATENT DOCUMENTS

| | | | |
|---|---|---|---|
| 3,494,133 | 2/1970 | Ahlgren et al. | 405/260 |
| 3,608,318 | 9/1971 | Levy et al. | 405/269 X |
| 3,623,330 | 11/1971 | Nakade et al. | 405/266 X |
| 3,665,717 | 5/1972 | Sweeney et al. | 405/260 |
| 3,815,368 | 6/1974 | Turzillo | 405/260 |
| 3,878,686 | 4/1975 | Hageman et al. | 166/295 X |
| 3,973,409 | 8/1976 | Asayama | 405/260 |

FOREIGN PATENT DOCUMENTS

| | | | |
|---|---|---|---|
| 1904371 | 7/1970 | Fed. Rep. of Germany | 405/260 |
| 291766 | 10/1953 | Switzerland | 405/269 |
| 285620 | 3/1971 | U.S.S.R. | 405/269 |

*Primary Examiner*—Stephen J. Novosad

*Attorney, Agent, or Firm*—Auslander, Thomas & Morrison

[57] ABSTRACT

A method is disclosed of providing a grouted anchorage in a base formation. A tube having a drill member at its forward end is driven into the base formation through an opening in a wall. An anchor rod is introduced once the desired depth has been reached, liquid mortar is forced through the tube to the forward end of the tube and the tube is withdrawn from the hole. The forward end of the tube is continuously kept closed, sealed from penetration by water. During the initial withdrawal of the tube a corresponding amount of liquid mortar is forced therethrough, the anchor rod being pressed against the drill tip which remains in the base formation.

8 Claims, 6 Drawing Figures

6
24
14
26
9
10
16
16a
5
4
6
25
9
24
16
16a
5
4

METHOD AND AN APPARATUS FOR PROVIDING A GROUTED ANCHORAGE AGAINST HYDROSTATIC PRESSURE

FIELD OF THE INVENTION

The invention relates to a method of providing an anchorage in a ground formation by grouting under pressure, wherein a propelling tube is driven into a base formation, for example the ground, through an opening in a wall, an anchor rod is introduced once the desired depth has been reached, liquid mortar is forced through the tube to the forward end of the tube and the tube is finally withdrawn from the base formation. The invention also relates to an apparatus for carrying out this method and, in particular, an apparatus which comprises a propelling tube composed of one part or a plurality of parts and a drill tip positioned on the tube.

BACKGROUND OF THE INVENTION

Grouted anchorages are often used in connection with means for securing faults in a base formation, for example in the case of excavation retaining walls, and for safety in lifting. They consist of one or a plurality of steel braces and an anchoring member formed in the base formation such as the ground. Grouted anchorages of this type are introduced into the soil by various drilling methods and secured there. The anchoring member is secured in the ground by injecting cement mortar once or a plurality of times, which then sets to form the anchorage. The provision of a grouted anchorage in the ground is successful, subject to certain restrictions, even if a water super-pressure builds up behind the wall at the anchoring position.

It is known, when placing grouted anchorages against a small excess hydrostatic pressure to provide seals at the anchoring position which are formed of packings or sleeves and which are located between the propelling tube and the passage in the wall to seal the gap therebetween. It is also known to provide a resilient lip seal which bears resiliently against an anchoring rod having a smaller diameter than the propelling tube once the propelling tube has been removed and which thus prevents the soil under excess hydrostatic pressure behind the wall passage from flowing out. Although the seal remains effective between the wall passage and the propelling tube as the hydrostatic pressure increases, water and particles of soil can penetrate into the propelling tube after ejection therefrom of the drill tip or other drilling tool which remains in the ground. The water and particles of soil can flow out through the tube and thus pass through the retaining wall, an effect which is not acceptable particularly if there are rigid structures located above the anchoring position.

BRIEF SUMMARY OF THE INVENTION

The object of the invention is to allow grouted anchorages to be provided in base formations through a passage in a wall even against high hydrostatic pressure, without constituents of the soil and water being able to pass through or round the tube to the other side of the wall.

According to the invention there is provided a method of providing a grouted anchorage in a base formation, wherein a tube having a forward end carrying a drill member and a rear end is driven into the base formation to a desired depth through an opening in a wall, thereby to form a hole, an anchor rod is introduced once the desired depth has been reached, liquid mortar is forced through the said tube to the said forward end of the said tube and the said tube is withdrawn from the hole, wherein the forward end of the said tube is kept sealed against penetration therein by water, and wherein during initial withdrawal of the said tube, a corresponding amount of liquid mortar is forced therethrough, the anchor rod being pressed against the drill member which remains in the base formation.

A preferred form of the method of the invention is carried out as follows. A propelling tube is firstly driven through the opening in the wall into the soil to the required depth. The forward end of the tube is sealed with a drill tip or other type of drilling tool having a frustoconical surface which mates with a corresponding surface of the tube to give a snug fit. If desired an additional seal, for example in the form of an inserted sealing ring, can be provided in the region of the mating surfaces. The drilling tool may, for example, be a pile tip or a drilling head which is provided with a passage for rinsing water and a check valve which allows rinsing water to flow out of the drilling head but which prevents water from the soil from entering the tube.

When the tube has been driven into the ground to the desired depth, the anchor rod is inserted into it, whereupon the tube can be withdrawn a short distance from the drill tip and mortar under pressure simultaneously forced through the tube to form the anchoring member. A seal which is arranged inside the tube cooperates with the surface of the anchor rod and allows the mortar under pressure to pass through to the anchoring section but prevents water and consistuents of the soil from being rinsed out of the ground in the opposite direction through the tube. While the tube is being withdrawn, the anchor rod is forced by means of a compression bar introduced into the tube through the rear end thereof against the drill tip remaining in the ground and is thus held in its desired position. The anchor rod is guided through a seal in a compression cap screwed on to the rear end of the tube so that a closed pressurised system is ensured throughout the grouting process and thus throughout the production of the anchoring member.

Upon completion of the grouting, i.e. upon completion of the entire length of the anchoring member, the tube is progressively withdrawn from the region of the anchoring member and, if it comprises a plurality of sections, these are unscrewed from one another.

A short length of the tube at the forward end thereof which contains the frusto-conical seat for the drill tip and which is referred to below as the advance member is fixed on the part of the tube removed last of all. When this end of the tube is located at about the middle of the opening in the wall, a plug is injected into the opening and the adjacent bore hole. This plug consists of a plastic composition which reacts and foams upon contact with water. The foamed plug thus formed seals the opening round the anchor rod so that no particles of earth or water pass from the ground behind the wall through the opening in the wall.

The invention can be used for providing both temporary and permanent grouted anchorages which extend anywhere from horizontally to vertically.

DETAILED DESCRIPTION OF PREFERRED EMBODIMENTS

Figure 1:
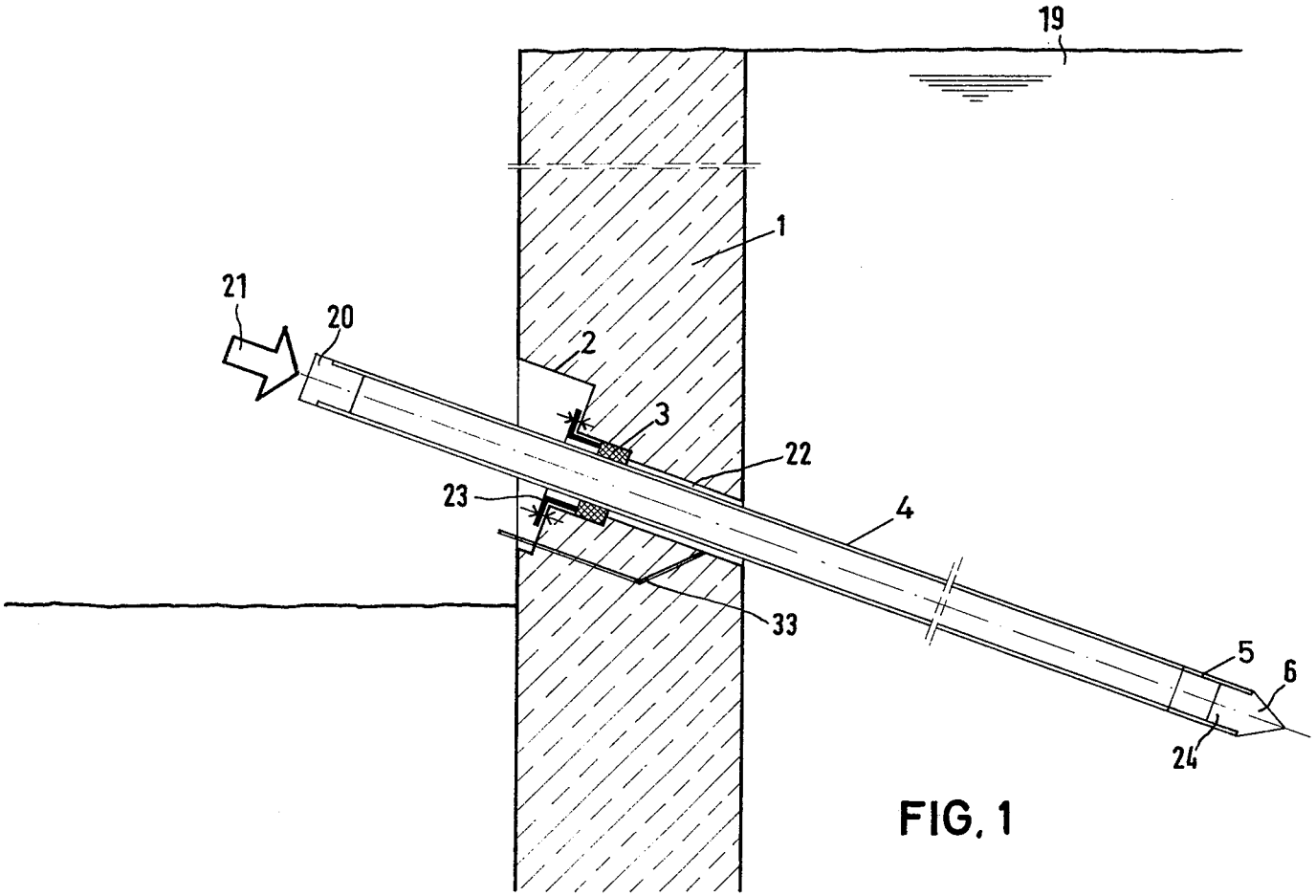
FIG. 1 is a vertical section through a wall having an obliquely direct opening therein through which a propelling tube is forced into the ground located behind it.

FIG. 1 shows a tube comprising a plurality of parts which are screwed together. The tube is driven through an opening 2 in a wall 1 for the purpose of providing a grouted anchorage in the ground 19 lying behind the wall. Propelling forces, for example piling blows, are exerted in the direction of an arrow 21 on an anvil 20 inserted in the rear end of the tube 4. A sealing packing 3 is located inside a portion 22 of the opening 2 in the wall 1 and cooperates with the exterior of the propelling tube 4. The packing 3 can be compressed to give a complete seal by an adjustable flanged bush 23.

A tubular advance member 5 is screwed on the forward end of the tube 4. A drill tip 6 is inserted into the forward end of the tube 4 to give a water-tight fit therewith. For this purpose, the drill tip 6 is provided with a frusto-conical shaft 24 which cooperates with a mating surface 25 of corresponding cone angle in the advance member 5. The cone angle of the drill tip is selected to be such as to prevent the formation of a permanent connection between the tip and the tube.

An encircling groove 26 is machined into the surface 25 and a sealing ring 9, for example a round cord ring, is inserted into this groove.

Figure 2:
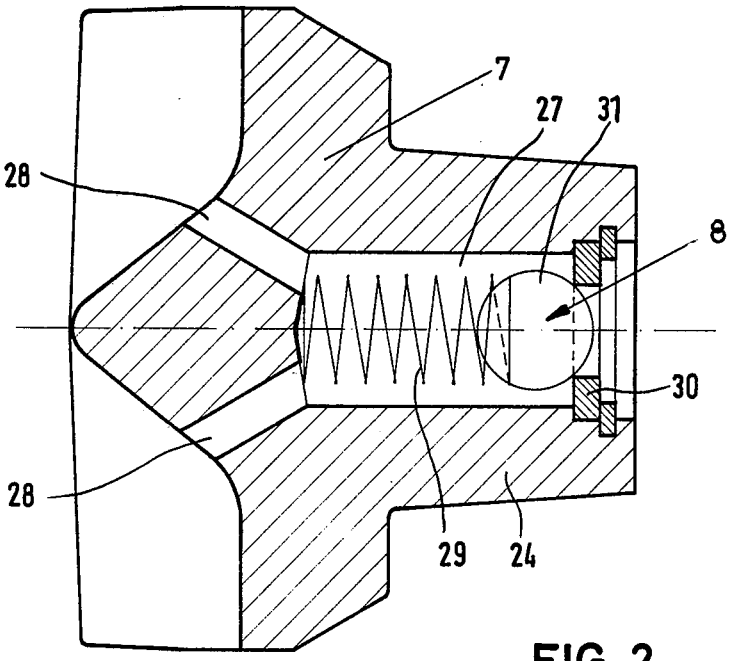
FIG. 2 shows a section through a piling drill head.

If the ground to be penetrated is highly compacted, a drill head 7 (FIG. 2) which is suitable for pile drilling can be inserted into the advance member 5 instead of the drill tip 6. The drill head 7 is provided with a frusto-conical shaft 24 identical to that of the drill tip 6, but is also provided with an axial passage 27 with passages 28 branching therefrom so that rinsing agent which is supplied through the tube 4 (in a manner which is not illustrated) can issue through the drill head 7. A check valve 8, which comprises a ball 31 which is pressed against a seat ring 30 by a compression spring 29, is arranged in the passage 27 in order to prevent water and/or particles of earth from penetrating through the passage 27 into the tube. A drill head 7 of this type allows rinsing water to be used to assist the tube in advancing into the ground, but prevents water and earth from penetrating through the drill head into the tube 4 if, for example, the tube has to be lengthened and no rinsing water can be supplied during this period.

Figure 4:
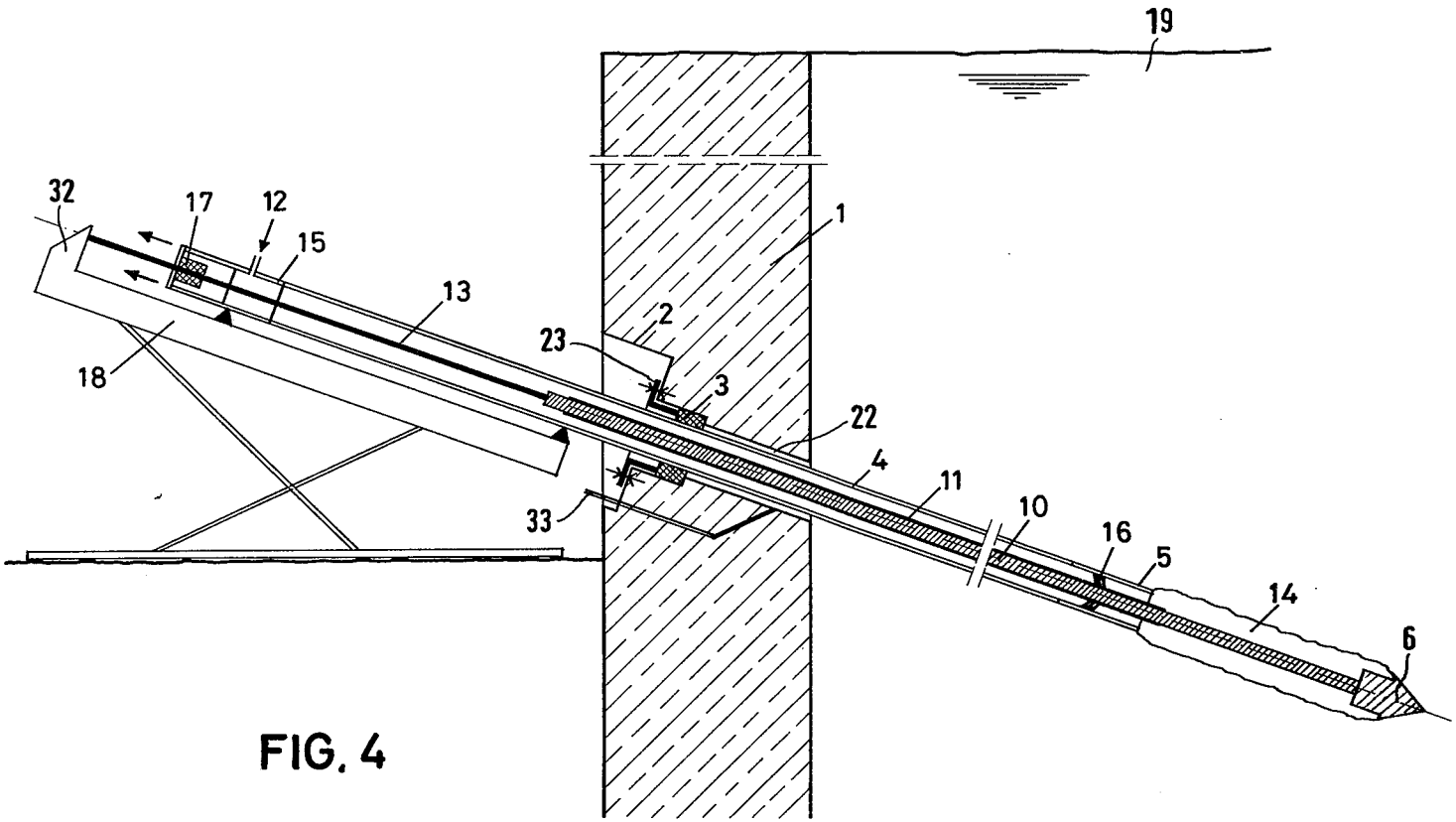
FIG. 4 shows a section similar to FIG. 1, illustrating the production of the grouted section and the withdrawal of the tube.
Figure 5:
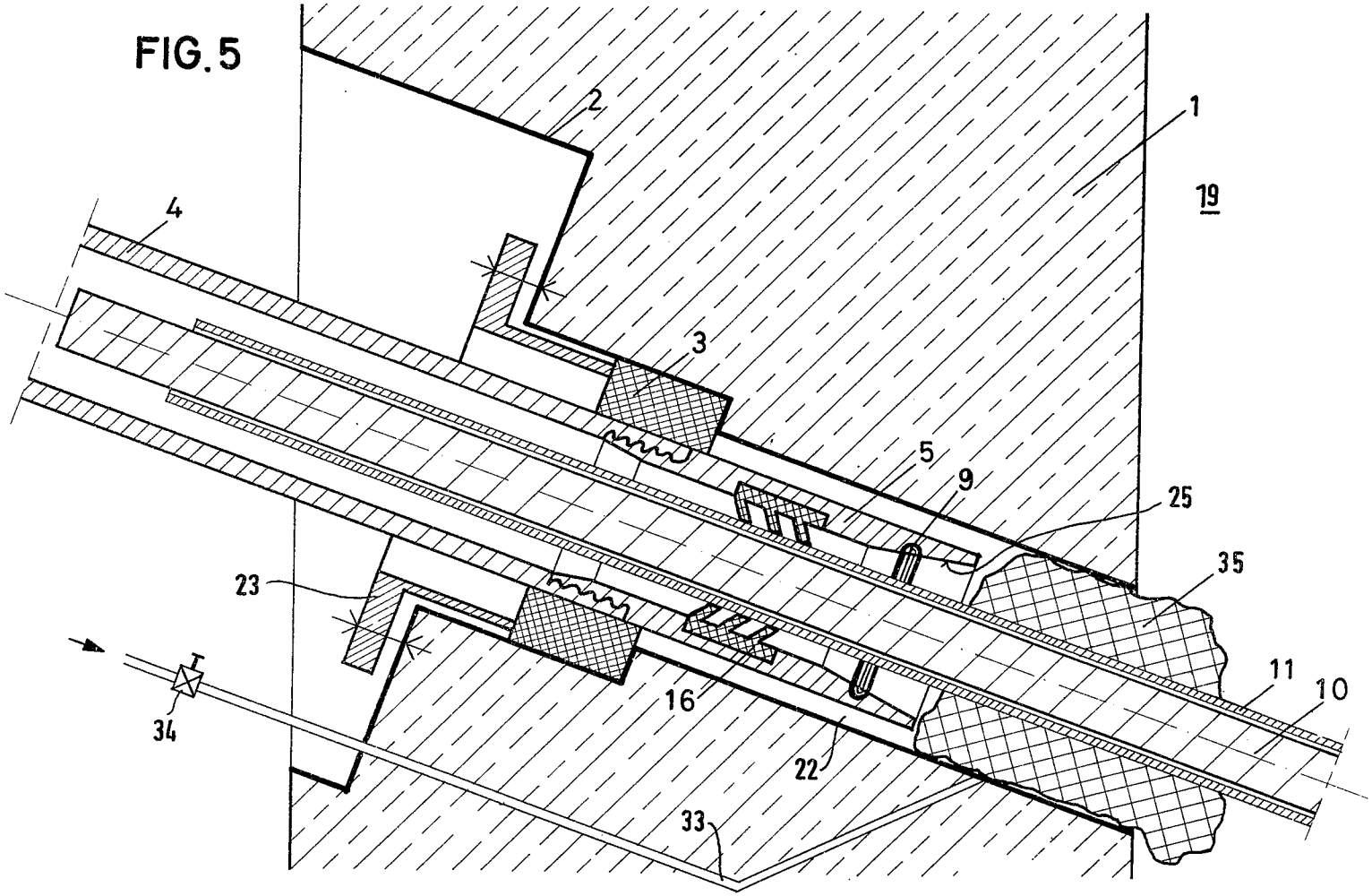
FIG. 5 shows a section through the opening in the wall on an enlarged scale, illustrating the positioning of the injected plug sealing the opening in the wall.

Once the tube 4 has been driven to the required depth in the ground 19, the anvil 20 is removed from the rear end of the tube 4 and an anchor rod 10 and a protective tube 11 covering part of the surface thereof are inserted into the tube 4 until the anchor rod rests against the frusto-conical shaft 24 of the drill tip 6 or the drill head 7. The length of the anchor rod 10 is such that its rear end projects beyond the wall 1, as illustrated in FIGS. 4 and 5. The rear end of the tube 4 projects beyond the rear end of the anchor rod 10 and supports a compression cap 15 with an inlet 12 for mortar under pressure. A compression bar 13 is sealed and guided through the compression cap 15 and rests against the rear end of the anchor rod 10, being guided out of the rear end of the tube 4 through a seal 17. The rear end of the compression bar 13 rests against an abutment 32 of a pulling carriage 18 which is used for withdrawing the tube 4 while the anchor rod 10 and the drill tip 6 or the drill head 7 remain in the ground, being adjusted and held in the desired position as the tube is withdrawn.

Figures 3A, 3B:
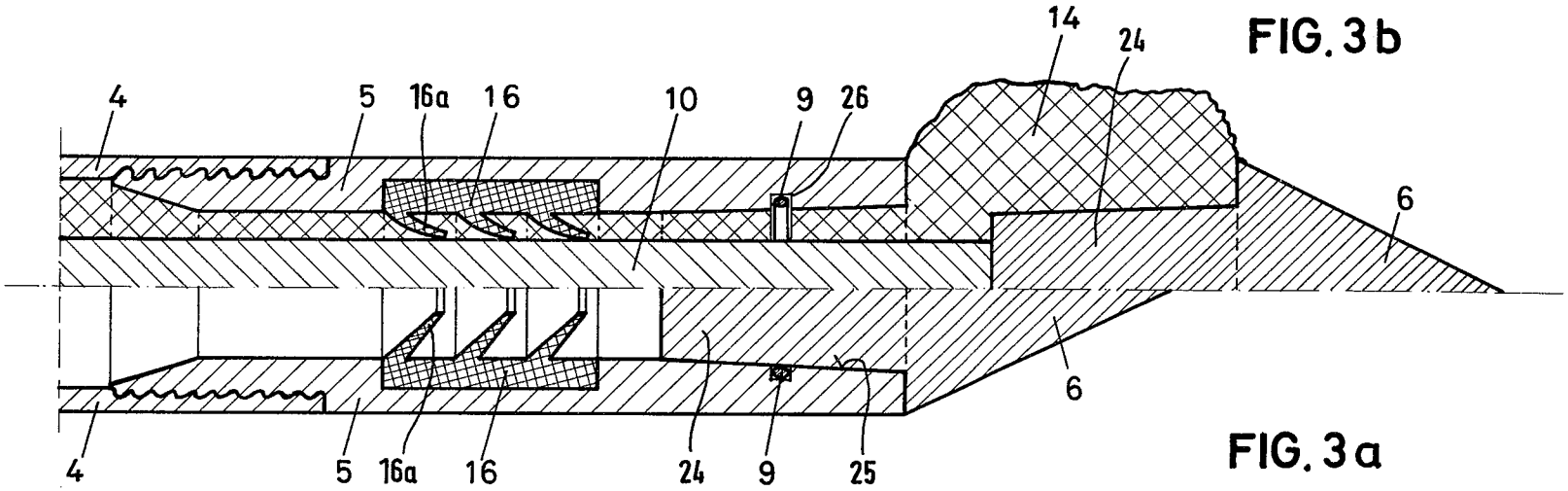
FIG. 3*a* shows a longitudinal section through an advance member screwed on to the front end of the tube with a fitted drill tip, in the condition existing when the tube is being driven.
FIG. 3*b* shows a longitudinal section similar to FIG. 3*a* in which the tube with the advance member is withdrawn a short distance from the drill tip remaining in the ground after introduction of an anchor rod, and shows that mortar under pressure is forced through the tube in order to form the anchoring member.

As the tube 4 is withdrawn, the advance member 5 can easily be detached from the frusto-conical shaft 24 of the drill tip 6 or of the drill head 7. Simultaneously with this withdrawal, mortar is supplied under pressure through the compression cap 15 and passes between the internal walls of the tube 4 and advance member 5 and the external wall of the anchor rod 10 or of the protective tube 11 resting thereon to the forward end of the advance member 5. There the mortar issues to form the anchoring member 14 which is formed as the tube 4 is withdrawn. The anchoring member 14 is shown partly formed in FIG. 3*b* and completed over its entire length in FIG. 4. The mortar is forced under pressure past a resilient seal 16 fixed inside the advance member 5. The seal 16 has lips 16*a* which normally cooperate with the surface of the anchor rod 10 to prevent hydrostatic pressure in the ground 19 releasing the seal and forcing water and parts of the ground into the tube 4. For this purpose, the lips 16*a* of the lip seal 16 are pressed by the inserted anchor rod 10 towards the forward end of the advance member 5, as shown clearly in FIG. 3*b*.

The anchoring member 14 is formed gradually by the withdrawal of the tube 4 and the simultaneous forcing of cement mortar down the tube, the pulling carriage 18 being used for withdrawing the tube 4 and for holding the compression rod 13. Once the tube 4 has been withdrawn far enough for the anchoring member 14 to reach its desired length, no more cement motar is supplied. The tube 4 continues to be withdrawn and removed bit by bit, the lip seal 16 located in the advance member 5 preventing water and particles of earth from the ground 19 from penetrating the tube 4.

FIG. 4 shows that the protective tube 11 covers the section of the anchor rod 10 projecting from the anchoring member 14.

Once the tube 4 has been withdrawn sufficiently for the advance member 5 to lie in about the centre of the opening 22, a plastic composition is forced through a pipe 33 with a fitted valve 34 into the inner end of the opening 22. The composition foams under the influence of moisture and forms a sealing plug 35 which outwardly seals the opening 22 round the anchor rod 10 and the protective tube 11 resting thereon. Once the sealing plug 35 has cured, the last part of the tube 4 with the advance member 5 screwed thereto can be removed and an end seal, for example a rubber stopper, can be fitted between anchor rod and wall passage. A nut or other type of tightening element can then be arranged on the projecting end of the anchor rod 10 in a conventional way.

We claim:

1. A method of providing a grouted anchorage in a base formation including the steps of driving a tube into a base formation to a desired depth through an opening in a wall and forming a hole thereby, said tube having a forward end carrying a drill member and a rear end, driving said tube from said rear end to said desired depth, introducing an anchor rod into said tube once the desired depth of said tube has been reached, forcing liquid mortar through said tube to the said forward end of the said tube, then withdrawing said tube from said hole while simultaneously pressing said anchor rod against said drill member maintaining said drill member in said base formation, and the step of injecting material into the upper end of said hole, said material adapted to foam and form a plug in contact with water, whereby the forward end of said hole is kept sealed against penetration therethrough by water upon withdrawal of the said tube.

2. A method according to claim 1, including the step of forcing a rinsing liquid through the said tube to said drill member as said tube is driven into said base formation.

3. Apparatus for use in providing a grouted anchorage in a base formation comprising a tube, said tube having a forward end and a rear end, said forward end including an advance member, said advance member having an internal frusto-conical surface, a drill member, said drill member including a shaft with an external frusto-conical surface, said frusto-conical surfaces releasably mating, sealing means for sealing the forward end of said tube against penetration of water therein, and an anchor rod, said anchor rod adapted to extend longitudinally within said tube and abut said drill member.

4. The apparatus according to claim 3 including an additional seal located in the region of said mating frusto-conical surfaces.

5. The apparatus according to claim 3, wherein said drill member is in the form of a drill head including a rinsing agent duct containing a check valve.

6. The apparatus according to claim 3 wherein the said seailng means in said forward end is a lip seal cooperable with the surface of the said anchor rod.

7. The apparatus according to claim 3, including a compression cap for permitting the introduction of liquid mortar, said compression cap adjacent said rear end of said said tube.

8. The apparatus according to claim 7, wherein said compression cap is adapted to receive a compression bar and further includes a seal for said compression bar.

* * * * *